250-506.1 SR
OR 4,147,938

United Sta
Heckman et al.

[11] 4,147,938
[45] Apr. 3, 1979

[54] FIRE RESISTANT NUCLEAR FUEL CASK

[75] Inventors: Richard C. Heckman; Marvin Moss, both of Albuquerque, N. Mex.

[73] Assignee: The United States of America as represented by the United States Department of Energy, Washington, D.C.

[21] Appl. No.: 875,821

[22] Filed: Feb. 7, 1978

[51] Int. Cl.² ..... G21F 5/00
[52] U.S. Cl. ..... 250/506; 250/518
[58] Field of Search ..... 250/506, 507, 515, 518; 165/32, 181, 182, 183; 236/35.2; 176/41, 43, 92 B

[56] References Cited

U.S. PATENT DOCUMENTS

| | | | |
|---|---|---|---|
| 1,459,318 | 6/1923 | Birdsall | 165/32 |
| 3,307,783 | 3/1967 | Wiebelt | 165/32 |
| 3,362,467 | 1/1968 | Kummerer | 165/32 |
| 3,500,016 | 3/1970 | Karmazin | 165/182 |
| 3,780,306 | 12/1973 | Anderson et al. | 250/507 |

*Primary Examiner*—Bruce C. Anderson
*Attorney, Agent, or Firm*—Dean E. Carlson; Dudley W. King; Robert Southworth, III

[57] ABSTRACT

The disclosure is directed to a fire resistant nuclear fuel cask employing reversibly thermally expansible bands between adjacent cooling fins such that normal outward flow of heat is not interfered with, but abnormal inward flow of heat is impeded or blocked.

9 Claims, 3 Drawing Figures

FIRE RESISTANT NUCLEAR FUEL CASK

FIELD OF THE INVENTION

The invention relates to a bimetallic band device which improves the fire resistance of a nuclear fuel cask.

BACKGROUND

Spent nuclear fuel elements, being radioactive and generating significant thermal energy, require special containers or casks for storage and transportation from a reactor to a reprocessing or storage site.

A number of such spent fuel shipping casks have been designed. Typical construction, as exemplified by U.S. Pat. No. 3,113,215 to Allen, includes a central cavity, an inner container or shell, a radiation shielding filler, an outer container or shell, and heat rejecting fins projecting outwardly from the outer shell.

Federal regulations currently require that a spent fuel shipping cask survive an 802° C. fire for ½ hour. The heat rejecting fins, which normally serve to conduct heat away from the cask interior, may then conduct heat inwardly. This, of course, is undesirable as it reduces the ability of a cask to withstand a fire.

One proposed method of fire protection is that of extinguishing the fire by liquids, foams, or gases. If such extinguishing agents are contained within the cask itself, it may be difficult to provide an effective amount of the agent. On the other hand, if the extinguishing agent is located within the carrier used to transport the cask, the extinguishing agent may become ineffective if the cask and carrier become separated.

A method disclosed by U.S. Pat. No. 3,414,727 to Bonilla would cool the cask surrounding the radiation shield with a safety shield of material which melts at a temperature lower than the radiation sheild and adapted to flow out of its enclosed space when subjected to external heat.

Another concept is to incorporate a hydrated substance within the cask. Exposure to an exterior heat source would cause dissociation and vaporization of the contained water; heat would be rejected as latent and sensible heat as the resultant water vapor was vented from the cask. Examples of such substances are: hydrated calcium sulfate (plaster) as disclosed in U.S. Pat. No. 3,466,662 to Blum or hydrated aluminum and iron oxides as disclosed by U.S. Pat. No. 3,780,309 to Bochard. These methods suffer the disadvantage that a limit to the amount of heat that may be rejected is set by the amount of hydrated material that is contained within the cask. Furthermore, if the water within the hydrated substance is relied upon for neutron shielding, that shielding is degraded upon exposure to fire.

A related concept, as disclosed by U.S. Pat. No. 3,737,060 to Blum would place neutron shielding such as borated wood or aluminous cement on the exterior of the outer shell and between the heat rejecting fins. This arrangement presumably would afford some fire protection through charring of the wood or dehydration of the cememt; however it would again suffer the disadvantages noted above.

It is known, especially in the art of designing skins for spacecraft, that certain bimetallic devices may be used for controlling the spacecraft skin temperature by controlling the emissivity of that surface (see, for example, U.S. Pat. Nos. 3,205,937, 3,220,647, 3,307,783, 3,362,467, and 3,411,156). In general, those devices are designed to operate in the cold vacuum of outer space and are effective for radiative heat transfer. The present invention is designed to operate at atmospheric pressure and temperatures ranging from ambient to those found in flames. The present invention is effective in controlling heat transfer by conduction and convection as well as by radiation.

Ablative or intumescent materials could be applied to the surface of the cask, but these materials could interfere with normal fin heat rejection.

Thermal isolation of the cask may be accomplished by irreversibly decoupling the fins from the cask; for example, by melting the fin substructure or by the formation of cavities near the fin surface. These schemes, along with most of the other proposed methods, suffer the disadvantage of irreversibility. Generally, after a fire wanes, human intervention would be required to restore the thermal conductivity of the cask and thereby prevent excessive temperature rise from internal heat generation. Depending on accident conditions, such human intervention may not be possible.

SUMMARY OF THE INVENTION

In accordance with the present invention there is provided a plurality of metallic bands, individually located between adjacent cooling fins of a nuclear fuel cask. Each band may be comprised of strips of two dissimilar metals bonded together along a side and formed to the general contour of the cask each band encircling or girdling the cask. Upon heating such as in an accidental fire, the bands expand to block normal heat transfer between the fins and the environment.

One object of the present invention is to provide improved fire protecton for nuclear fuel casks.

Another object of the present invention is to provide fire protection for nuclear fuel casks which is fully automatic and does not require human intervention for deployment.

One advantage of the present invention is that it is fully reversible, with the cask automatically returning to its prefire configuration following extinguishing of the fire.

Another advantage of the present invention is that quantities of consumable fire extinguishing agents or heat removal agents are not required for its operation.

DESCRIPTION OF DRAWINGS

Other objects and advantages of the present invention will be apparent to those skilled in the art from the following description with reference to the appended drawings, wherein.

DETAILED DESCRIPTION OF A PREFERRED EMBODIMENT

A spent nuclear fuel cask is generally designed to achieve at least the following goals to provide for the safe containment and transportation of spent nuclear fuel:

(1) Prevention of escape of radioactive fission fragments, (2) Shielding of hazardous penetrating radiation, (3) Dissipation of thermal energy generated in radioactive decay, and (4) Assurance of the continued performance of the first three goals in spite of accidents such as collision, derailment, or fire.

Figure 1:
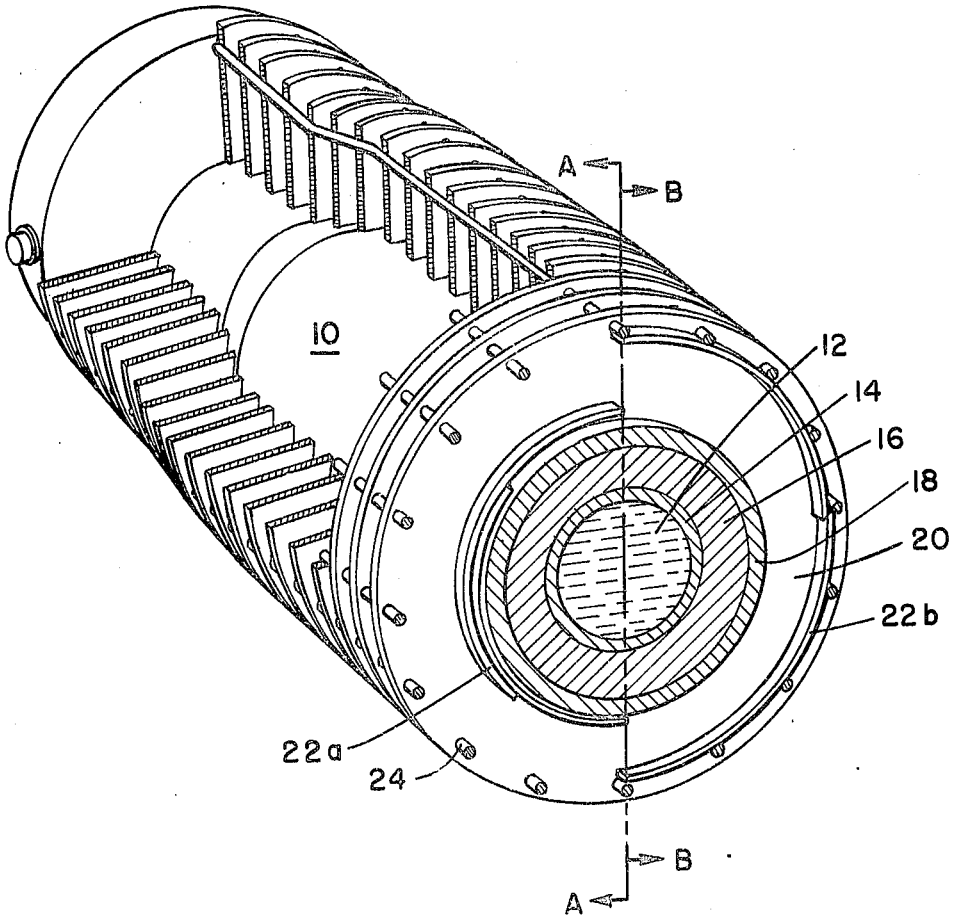
FIG. 1 illustrates in split cross section a nuclear cask with a bimetallic band both in a normal and in an expanded position.

In FIG. 1 such a spent nuclear fuel cask 10 is seen employing the bimetallic band fire protector of this invention. Within the cask is a chamber 12 adapted for containing spent nuclear fuel. Also within the chamber there may be a heat transfer fluid for transmitting the heat generated by the fuel to the inner shell 14. This heat may be substantial, about 1 Kw per fuel pin with the surface temperature of the pin as high as 1000° F. The heat transfer fluid may be a metal alloy such as lead-bismuth, sodium-potassium, or sodium; a gas such as helium or argon; a liquid such as water or organic compounds; or a heat transfer salt such as $NaNO_3$—$NaNO_2$—$KNO_2$; or the like. The inner shell serves to contain the spent fuel and heat transfer fluid, provide a barrier to the spread of radioactive contamination, and provide structural strength to the cask.

Surrounding the inner shell is a layer of nuclear shielding 16. The function of the nuclear shielding is to attenuate and absorb gamma and neutron radiation emitted by the spent nuclear fuel carried with the chamber 12. It may be advantageous to construct the nuclear shielding of multiple layers of different materials for attenuating the radiation and it may even be advantageous to place a portion of the shielding exterior to outer shell 18. Materials suitable for gamma shielding generally have high atomic weights and include lead, uranium, and depleted uranium. Materials suitable for neutron shielding generally have low atomic weights and include hydrogenous materials, water, metal hydrides, boron carbide, boron carbide-copper cermet, borated beachwood, hydrocarbons and the like. Suitable shielding materials also satisfactorily pass heat from the inner shell to the outer shell 18.

The outer shell furnishes an additional barrier to the spread of radioactive contamination, provides additional structural strength, and supplies a convenient surface for the attachment of heat rejecting fins 20. The use of heat rejecting fins increases the surface area of the cask from which thermal energy can be rejected through the processes of radiation, conduction, or convection. In an accident environment, such as a fire, the heat rejecting fins may serve to conduct additional heat into the cask. This, of course, is undesirable insofar as it adversely affects the structural integrity of the cask or its contents.

The method of the present invention utilizes a bimetallic band 22 to reduce the effective surface area of the fins during a fire and thus reducing the heat input to a cask during such as accidental occurrence. The bimetallic band, as 22*a*, is normally disposed between two adjacent fins and close to the outer surface of the outer shell where the band does not interfere with the rejection of heat by the fins.

Should the cask be exposed to a high heat source such as a fire, the bimetallic band automatically expands outwardly, as 22*b*, interfering with radiation or convective heat transfer. The band may be restrained from over expanding by the use of a band retainer 24. As pictured, the band retainer may be a plurality of rods or pins positioned transverse to the fins, at the periphery of the fins.

The bimetallic band may be fabricated from two strips of metal having dissimilar expansivities bent to a desired radius and affixed together along a side. It can be shown that a bimetallic strip of two dissimilar metals of equal thickness, t, will, if at an initial radius of curvature $R_1$ expand to $R_2$ in the temperature interval $$T_2 - T_1 = \frac{-Kt}{(\alpha_a - \alpha_b)}\left(\frac{1}{R_2} - \frac{1}{R_1}\right)$$

where $$K = \frac{12\,E_aE_b + (E_a + E_b)^2}{12\,E_aE_b}$$

The $\alpha$'s and E's are the respective expansivities and elastic moduli of the component materials. The choice of materials is affected by the need for good response to a moderate rise in temperature, and the ability to withstand a high temperature. Although many such alloys will be obvious to those skilled in the art, two which may be used are type 304 stainless steel (18% Cr, 8% Ni, balance Fe) and Kovar (29% Ni, 17% Co, balance Fe). For 304SS-Kovar, $\alpha_a - \alpha_b = 11 \times 10^{-6}/°$ C., and K = 1.34. For use in a cask with an exterior radius of 18.4 cm and a fin radius of 22.7 cm a 304SS-Kovar band with t of 0.076 cm will perform the desired expansion within a temperature change of 100° C.

The bimetallic band may be fabricated by forming the different metal strips to the desired radius of curvature and then affixing them together along one side with the higher expansivity metal being on the inside of the curve. It has been found that spot welding the strips at 1.8 cm intervals gives satisfactory results. The band may be fabricated such that the ends overlay in the normal position and so that full protection is afforded in the expanded position.

Other materials which behave similarly to bimetallic strips may also be used. One example is the uranium-niobium alloy of U.S. Pat. No. 3,567,523 which displays thermally reversible, pseudo-plastic strain behavior.

Figure 2:
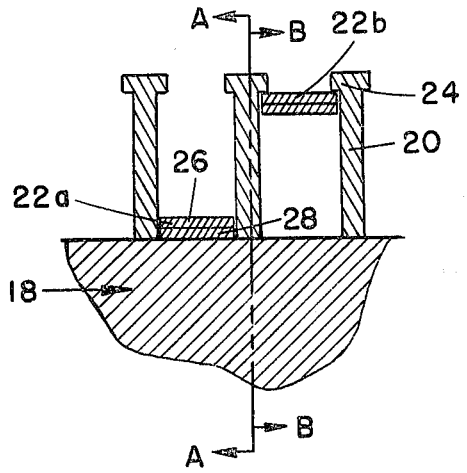
FIG. 2 illustrates in split cross section the fins of a nuclear cask with an alternate band retaining means.

Referring now to FIG. 2, which is a fragmentary cross section of a nuclear fuel cask showing a portion of the outer shell 18 with three fins 20 attached to the outer surface, a bimetallic band 22*a* is shown in its normal position between two fins adjacent the surface of the outer shell. This bimetallic band is made up of two dissimilar metal strips 26 (Kovar) and 28 (304 stainless steel). The strip with the higher expansivity is located inwardly so as to cause an expansion or increase in the radius of curvature of the band upon application of heat.

The band is also shown as 22*b* in its expanded position. It is restrained from overexpansion by band retainer 24 which may be an enlargement of the fin cross section near the periphery of the fin. As can be seen, much of the fin surface is exposed when the band is in its normal position; and much of the fin surface is hidden when the band is in its expanded position.

EXAMPLE I

A one-quarter scale simplified model of a spent nuclear fuel cask was constructed. The cask body was simulated by thirty-four circular steel plates 0.635 cm thick and 36.8 cm in diameter. The fin portion was simulated by seventeen circular copper plates 0.163 cm thick and 45.4 cm in diameter. These plates were stacked, alternating two steel plates with one copper plate, and bolted together to form a cylinder with radial fins. A 2.5 cm hole penetrated the center of each plate simulating a central cavity as well as affording access for chromel-alumel thermocouples.

Bimetallic bands were fabricated from strips of 304 stainless steel and Kovar, each 0.076 cm thick, 1.22 cm wide, and 150 cm long. The strips were bent to the desired circular shape with the steel on the inside and then spot welded at 1.8 cm intervals. One bimetallic band was placed around the cask model and between each adjacent pair of fins.

With thermocouples placed near the center and near the edge of the cask model, the model was subjected to a test fire. This test fire was simulated by a pair of butane torches, with 7 cm throats, directed at the side of the cask from a distance of 15 cm for one-half hour.

Cask surface temperatures ran as high as 180° C. for a band-protected cask, as opposed to as high as 295° C. for an unprotected cask. Central temperatures were 115° C. for a band-protected cask, as opposed to 145° C. for an unprotected cask.

EXAMPLE II

Heat flow calculations were performed using the CINDA code (Chrysler Improved Numerical Differencing Analyzer for 3rd Generation Computers, Chrysler Corp. Space Div., New Orleans, LA).

For the purposes of these calculations, the cask was assumed to be 3 meters long with an internal generation of 100 Kw of heat. With fin area equal to 15× cask surface area, a skin temperature of 82° C. was calculated in an ambient temperature of 57° C.

A possible cross section of the cask was assumed to have the following radial dimensions:

TABLE I

| LAYER | RADIAL DIMENSION |
|---|---|
| Central cavity | 41 cm |
| Inner steel shell | 7 cm |
| Uranium gamma shield | 5 cm |
| Lithium hydride neutron shield | 5 cm |
| Uranium gamma shield | 6 cm |
| Outer steel shell | 6 cm |
| Fin | 16 cm |

The assumed fire was at 802° C. and lasted 0.5 hour; it was treated as a surface of unit emittance with all heat transferred by radiation.

Figure 3:
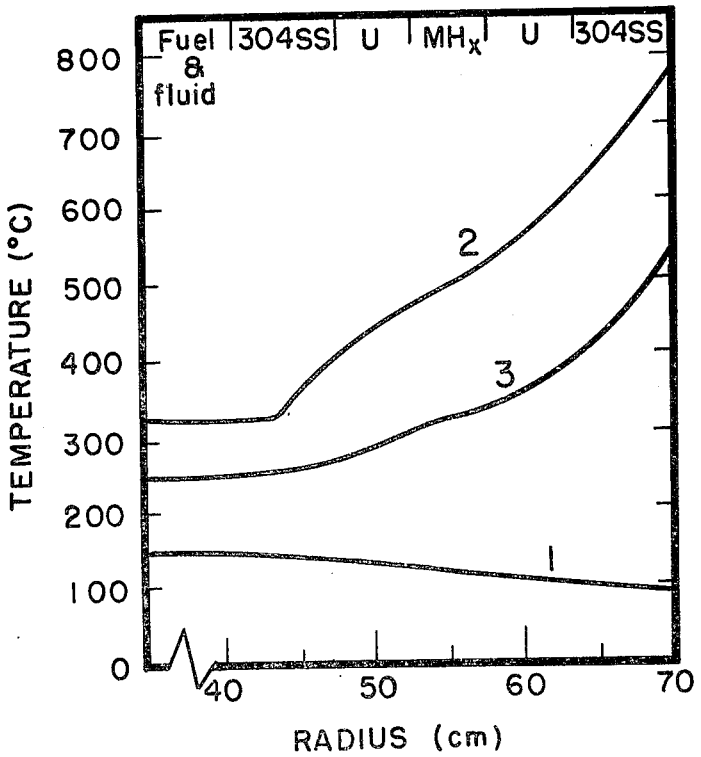
FIG. 3 illustrates in graphical form the calculated temperature profile of a nuclear fuel cask with and without the bimetallic band of this invention during a fire.

The results of the heat flow calculation are displayed in FIG. 3. Curve 1 shows the steady state temperatures with the cask surface fixed at 82° C. and 100 Kw generated internally. Curve 2 shows the maximum internal temperatures due to exposure without fire protection. Curve 3 shows the maximum internal temperature with fire protection.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. A fire resistant cask for transportation and storage of radioactive material comprising: an inner container for containing said radioactive material, a layer of gamma and neutron radiation shielding materials surrounding said inner container, an outer container surrounding said layer and inner container, a plurality of spaced apart heat conducting fins projecting outwardly from said outer container, and heat-expansible movable wall means intermediate said spaced apart fins substantially bridging the space between the fins with intermost surfaces at all times having substantial and direct exposure to the atmosphere, disposed closely adjacent to outermost surface of said outer container and the base of said fins during normal dissipation of heat through said fins from the inner container and reversibly movable upon subjection to high exterior temperature to a position adjacent outer extremities of said fins to house the fins against heat flow from the atmosphere through the fins to said outer container.

2. The fire resistant cask of claim 1 wherein the movable wall means comprises a plurality of bimetallic bands encircling said cask.

3. The fire resistant cask of claim 2 wherein each bimetallic band is curved and comprises an inner strip of metal having a higher linear coefficient of thermal expansion bonded along a side to an outer strip of metal having a lower coefficient of thermal expansion.

4. The fire resistant cask of claim 3 wherein the outer strip metal is an iron-nickel-cobalt alloy, the inner strip metal is an iron-chrome-nickel alloy, and said bonding is by spot welding at intervals along said strips.

5. The fire resistant cask of claim 1 wherein the movable wall means comprises a plurality of metallic bands comprised of an alloy with thermally recoverable and reversible pseudo-plastic strain behavior.

6. The fire resistant cask of claim 1 wherein means is provided for limiting outward movement of said movable wall means.

7. The fire resistant cask of claim 6 wherein the limiting means comprises a plurality of pins adjacent the outer extremities of said fins.

8. The fire resistant cask of claim 6 wherein the limiting means comprises projections adjacent the outer extremities of said fins extending over said movable wall means.

9. The first resistant cask of claim 1 wherein the cask is characterized by fire survivability of at least about 800° C. fire for about 30 minutes without structural damage and reestablishment of internal cooling without human intervention.

* * * * *